United States Patent [19]

Ando et al.

[11] 4,224,856

[45] Sep. 30, 1980

[54] WAVESHAPE MEMORY TYPE KEYBOARD ELECTRONIC MUSICAL INSTRUMENT

[75] Inventors: Shigeo Ando, Iwata; Takayasu Kondou, Hamamatsu, both of Japan

[73] Assignee: Nippon Gakki Seizo Kabushiki Kaisha, Hamamatsu, Japan

[21] Appl. No.: 938,254

[22] Filed: Aug. 30, 1978

[30] Foreign Application Priority Data

Sep. 5, 1977 [JP] Japan ..... 52/105793

[51] Int. Cl.[3] ..... G10H 1/02

[52] U.S. Cl. ..... 84/1.19; 84/1.24; 84/1.26

[58] Field of Search ..... 84/1.01, 1.03, 1.19, 84/1.21, 1.22, 1.24, 1.26, 1.27, DIG. 7

[56] References Cited

U.S. PATENT DOCUMENTS

| | | | |
|---|---|---|---|
| 3,809,789 | 5/1974 | Deutsch | 84/1.19 |
| 4,077,294 | 3/1978 | Hiyoshi | 84/1.24 |
| 4,133,242 | 1/1979 | Nagai | 84/1.26 |
| 4,138,915 | 2/1979 | Nagai | 84/1.19 |

*Primary Examiner*—J. V. Truhe
*Assistant Examiner*—William L. Feeney
*Attorney, Agent, or Firm*—Cushman, Darby & Cushman

[57] ABSTRACT

In a keyboard electronic musical instrument of waveshape memory type wherein different waveshapes read out from memories are mixed together at a variable mixing ratio according to variable parameters and then converted to a musical tone, the variable parameters are calculated on the basis of information associated with both lapse of time and the pitch of a musical tone to be produced. Thus, with this musical instrument, it is possible to produce a musical tone varying in the content of higher harmonics with respect to the pitch of the tone assigned to a depressed key and in tone color according to lapse of time.

14 Claims, 9 Drawing Figures

WAVESHAPE MEMORY TYPE KEYBOARD ELECTRONIC MUSICAL INSTRUMENT

BACKGROUND OF THE INVENTION (a) Field of the Invention

The present invention is related to a keyboard electronic musical instrument of the waveshape memory type wherein waveshapes with different tone colors read out from waveshape memories are mixed together and then converted to musical tones.

(b) Description of the Prior Art

In known keyboard electronic musical instrument of the so-called waveshape memory type, waveshape memories which have stored the required waveshapes are read out by a read-out address signal corresponding to a depressed key of the keyboard, and the resulting derived waveshapes are multiplied with an envelope shape which is intended to control the amplitude of the tone to be produced, and thus a musical tone is formed.

However, a musical tone which is pronounced by a natural musical instrument such as piano, in general, constantly varies in tone color as well as in amplitude with lapse of time from the time the tone is started to be pronounced till the extinction of this tone. Thus, the pronounced sound of the natural musical instrument is accepted to be rich as a musical tone to the ears of listeners. For example, in case of a piano, the tone has, at the time the tone is initially pronounced, complicated waveshapes containing a large number of higher harmonic components. Thereafter, the number of the higher harmonic components which were initially contained in the initially pronounced tone progressively decreases, and finally at the time the tone is about to disappear, the tone has a simple waveshape containing hardly any higher harmonic component. However, in the known keyboard style electronic musical instrument of the waveshape memory type, the waveshape of a musical tone which is read out from waveshape memories as a result of depression of a key of the keyboard represents always a mere repetition of a certain fixed waveshape from the time the tone is produced till the termination of the tone, and there is no such variation of tone color with lapse of time as noted with a natural musical instrument. Thus, the musical tone which is pronounced lacks richness and is provided as a monotonous tone. (This will hereinafter be called the first technical problem.)

Furthermore, a musical tone produced by a natural musical instrument, in general, is such that the content of higher harmonic components varies with the pitches of tones. More particularly, the content of higher harmonic components is usually smaller in a musical tone of a higher pitch, whereas the content of higher harmonic components is greater in abundance in a musical tone of a lower pitch. However, in the known keyboard style electronic musical instruments of the waveshape memory type, there has not been materialized an instrument which varies in the content of higher harmonic components for tones of different pitches. (This will hereinafter be called as the second technical problem.)

In view of the inconveniences discussed above of the conventional electronic musical instruments of the waveshape memory type, there has been worked out an invention in order to solve the above-said first technical problem concerning variation of tone color and amplitude with time, and U.S. Patent Application Ser. No. 898,523 was filled by the same assignee on Apr. 20, 1978, in which said invention is disclosed. According to the invention disclosed therein, it is possible to form a musical tone waveshape such that the content of higher harmonic components varies, i.e. waveshape configuration varies, only with time after depression of a key, in the same way as is noted in a natural musical instrument, and thus it is possible to produce a musical sound which gives a rich sensation when listened to.

This priorly proposed electronic musical instrument has an overall arrangement as shown in FIG. 1 in block form.

In this FIGURE, a keyboard circuit 1 is provided for selecting a musical tone to be produced in response to the depression of a key provided in the keyboard (not shown). Output lines of the keyboard circuit 1, which are assigned to the respective keys of the instrument keyboard, are connected to the address input of a frequency information memory 2 which contains frequency information corresponding to each key. When a key of the keyboard is depressed, the keyboard circuit 1 generates the logical "1" potential on the output line assigned to the depressed key to inform the key number of the selected keys to the frequency information memory 2. Along therewith, a key-on signal KON is delivered from the keyboard circuit 1 upon depression of said key. Thus, when a key is depressed, the memory 2 is accessed with an address given by the output lines of the keyboard circuit 1, and frequency information F corresponding to the depressed key is read out from the memory 2. The frequency information F thus read out is cumulatively added with a certain modulus in an accumulator 3 at each arrival of a clock pulse $\phi$. The temporary content qF (q represents an integer incrementing at each arival of the clock pulse $\phi$) is used as address information in accessing a plurality of waveshape memories 4, 5 and 6. In the respective waveshape memories 4, 5 and 6, there are stored, in digital representation, different waveshapes $W_1$, $W_2$ and $W_3$ as shown in FIGS. 2A, 2B and 2C, for instance. More particularly, the amplitudes for sample points of the waveshapes $W_1$, $W_2$ and $W_3$ are stored in the individual addresses of the waveshape memories 4, 5 and 6, respectively. The waveshape $W_1$ contains a large amount of higher harmonic components, and the waveshape $W_2$ contains a smaller amount of higher harmonic components. Whereas, the waveshape $W_3$ is a pure sinusoidal waveshape and contains substantially no higher harmonic component. All the waveshapes $W_1$, $W_2$ and $W_3$ have a same fundamental frequency.

The waveshape memories 4, 5 and 6 are successively accessed with addresses designated by the temporary contents qF of the accumulator 3, so that the waveshapes $W_1$, $W_2$ and $W_3$ are read out at a repetition rate corresponding to the depressed key of the keyboard. The derived waveshapes $W_1$, $W_2$ and $W_3$ having different tone colors are fed to a mixing circuit which consists of multipliers 7, 8 and 9 and an adder 10 to be mixed together in this mixing circuit at a ratio dependent upon the parameters $P_1$, $P_2$ and $P_3$ supplied from a parameter generating circuit 20. More particularly, the waveshapes $W_1$, $W_2$ and $W_3$ which are read out from the waveshape memories 4, 5 and 6, respectively, are multiplied in the multipliers 7, 8 and 9 with the associated parameters $P_1$, $P_2$ and $P_3$, respectively. The resulting outputs $W_i \cdot P_i$ $(i=1,2,3)$ of the multipliers 7, 8 and 9 are added up by the adder 10.

The parameter generating circuit 20 for generating parameter signals $P_1$, $P_2$ and $P_3$ is composed of a counter 11 and read-only memories 12, 13 and 14. The counter 11 is re-set by the key-on signal KON when said key of the keyboard is depressed, and thereafter again begins counting of the clock pulse $\phi$. The respective read-only memories 12, 13 and 14 are repetitively addressed with the contents in the counter 11, thus delivering the parameter signals $P_1$, $P_2$ and $P_3$. The values of the respective retrieved parameters $P_1$, $P_2$ and $P_3$ vary with time in such a manner, for instance, as shown in FIG. 3.

The output of the adder 10 is multiplied, in the multiplier 16, by an envelope shape EV supplied from an envelope generator 15, the resultant signal being converted through a sound system 17 to a corresponding musical tone. Upon depression of said key, the envelope generator 15 is initiated with the key-on signal KON to generate the envelope shape EV whose value changes with time in such a manner, for example, as shown in FIG. 4. The sound system 17 includes a loud speaker, a digital-to-analog converter for converting the digital output of the multiplier 16 to an analog signal, and an amplifier assigned to drive the loud speaker in response to the analog signal.

With the musical instrument described above, it is possible to produce a musical sound whose amplitude and tone color vary with lapse of time in accordance with the values of the envelope shapes EV and the parameters $P_1$, $P_2$ and $P_3$, respectively, as will be explained below by referring to FIGS. 3 and 4.

At the time $t_1$ when a key of the instrument keyboard is depressed, the parameters will be: $P_1=1$, $P_2=0$ and $P_3=0$, hence the output of the adder 10 of the mixing circuit contains only the component of the waveshape $W_1$. Accordingly, immediately after the key depression, a very colorful tone containing a large amount of higher harmonic components is produced, though the amplitude of the produced tone is suppressed very low. At the time $t_2$ when the envelope shape EV attains one half of a maximum level AL and therefore the produced tone attains one half of the peak intensity, the parameters will be: $P_1=0.5$, $P_2=0.5$ and $P_3=0$, so that there is outputted from the adder 10 a composite waveshape of two waveshapes $W_1$ and $W_2$ mixed together at a ratio of 1:1. Accordingly, the produced musical tone contains a smaller amount of higher harmonic components. At the time $t_3$ when the envelope shape EV and accordingly the produced musical tone have a maximum level, the parameters will be: $P_1=0$, $P_2=1$ and $P_3=0$. Accordingly, only the component of the waveshape $W_2$ is delivered from the adder 10, and thus the produced musical tone represents a relatively colorful tone color. Thereafter, the parameter $P_2$ as well as the level of the envelope shape EV will gradually become smaller with time, whereas the parameter $P_3$ will gradually increase. At the time $t_4$, the envelope shape EV is below the maximum level, and $P_1=0$, $P_2=0.5$ and $P_3=0.5$. The output of the adder 10, i.e. the produced musical tone, contains the components of the waveshapes $W_2$ and $W_3$ mixed at a ratio of 1:1. Thus, the produced musical tone has a relatively simple tone color, and the intensity is decreased. Thereafter, the parameter $P_2$ gradually decreases with time, and the parameter $P_3$ will gradually increase. At the time $t_5$ when the envelope shape EV decreases to zero, the produced musical tone contains only the component of the waveshape $W_3$ and thus has a simple tone color.

As such, the above-mentioned priorly proposed musical instrument is capable of producing a musical tone which is given a tone color and envelope varying only with time. In this musical instrument, however, the tone color of the produced tones is varied with time in the same manner independently of the pitch of this tone. Namely, the musical instrument proposed in this earlier application solves only the above-said first technical problem.

Also, there is another earlier U.S. Patent Application Ser. No. 773,788, now U.S. Pat. No. 4,138,915, filed on Mar. 2, 1977 by the same assignee. This earlier application mentions the desire that the second technical problem be solved. However, this application fails to provide any concrete means leading to its solution.

SUMMARY OF THE INVENTION

It is, therefore, the primary object of the present invention to provide a keyboard style electronic musical instrument which is capable of solving, at the same time, both of the above-said first technical problem (variation of content of higher harmonic components with time) and second technical problem (variation of content of higher harmonic components for pitches of tones).

Another object of the present invention is to provide an improved keyboard style electronic musical instrument of the waveshape memory type, which is capable of producing a rich musical tone greatly resembling a sound pronounced by a natural musical instrument.

Particularly, an object of the present invention is to provide an improved keyboard electronic musical instrument of the waveshape memory type as described above, which produces a musical tone whose tone color varies with lapse of time and also with the pitch of a tone which is desired to be pronounced.

According to the present invention, there is provided an electronic musical instrument comprising: a plurality of waveshape storage means storing different waveshapes and accessible in response to an operation of tone selection means for producing the different waveshapes; mixing means for obtaining a composite waveshape of said different waveshapes mixed at a variable mixing ratio in accordance with at least one variable parameter signal; conversion means for converting said composite waveshape to a corresponding musical tone; and parameter signal generating means for generating said variable parameter signal on the basis of first information related to time and second information related to the pitch of a musical tone to be produced by said instrument.

These and other objects, the advantages and the features of the present invention will become apparent by reading the following detailed description of the preferred embodiment of the present invention when taken in conjunction with the accompanying drawings.

BRIEF DESCRIPTION OF THE DRAWINGS

It should be understood that in FIG. 1 and FIG. 5, like parts are indicated by like references for the sake of simplicity.

DETAILED DESCRIPTION OF THE PREFERRED EMBODIMENT

Figure 1:
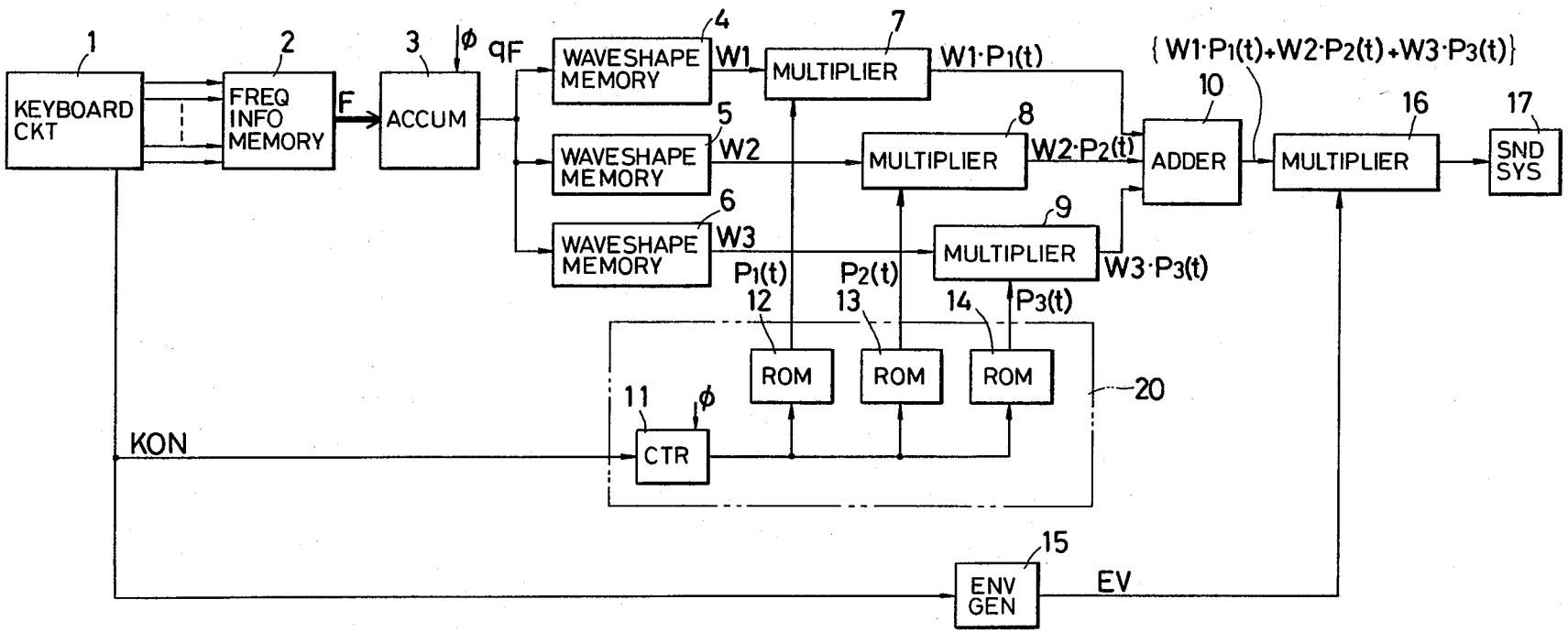
FIG. 1 PRIOR ART
FIG. 1 is a block diagram showing an electronic musical instrument which has been priorly proposed by the same assignee as that of the present application.
Figure 5:
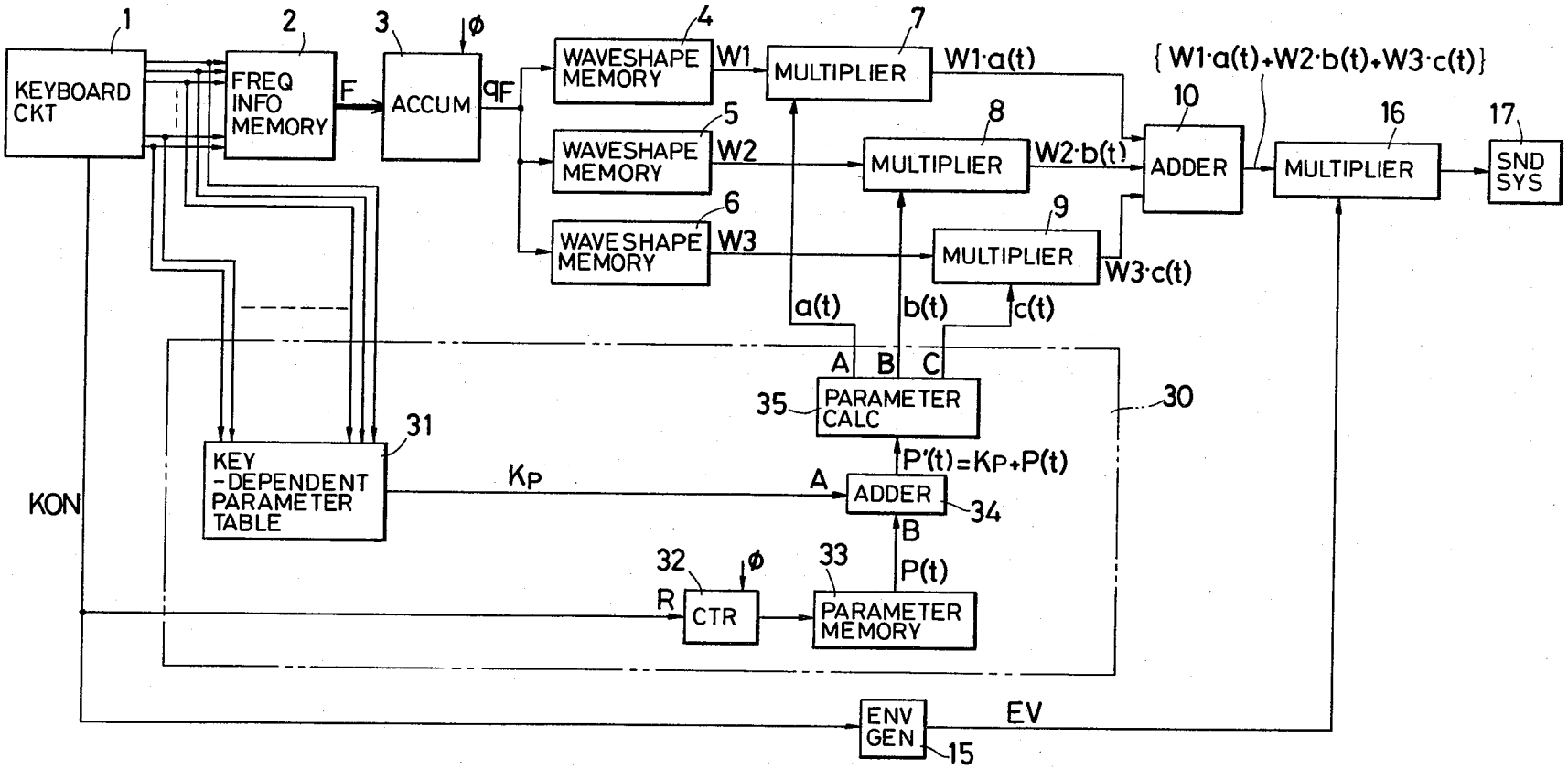
FIG. 5 is a block diagram showing an embodiment of the electronic musical instrument according to the present invention.

In FIG. 5 is illustrated in block form an example of an electronic musical instrument embodying the present invention, which has a basic structure similar to that of FIG. 1 excepting that the parameter signal generating circuit 20 in FIG. 1 which is composed of a counter 11 and ROM's 12–14 is replaced by a different parameter signal generating circuit 30.

The circuit 30 is composed of a key-dependent parameter table 31, a counter 32, a parameter memory 33, an adder 34 and a parameter calculator 35. An output of the keyboard circuit 1, which addresses the frequency information memory 2 on the one hand, is fed, on the other hand, to the address input of the key-dependent parameter table 31 whose output $K_p$ is supplied to an input terminal A of the adder 34. A key-on signal KON which is generated from the keyboard circuit 1, upon depression of a key of the keyboard not shown, is fed to re-set input terminal of the counter 32 and also to the envelope generator 15. This counter 32 is inputted with a clock pulse $\phi$ and delivers its content to the address input of the parameter memory 33. This memory 33, being accessed with an address supplied by the counter 32, delivers a time-dependent-parameter P(t) to another input terminal B of the adder 34. The parameter calculator 35 calculates variable parameters a, b and c, which will be described later in detail, depending on the nature of the output $P'(t)=K_p+P(t)$ of the adder 34, and these variable parameters a, b and c are supplied to their respective multipliers 7, 8 and 9 which are provided in the waveshape mixing circuit.

Figure 2A:
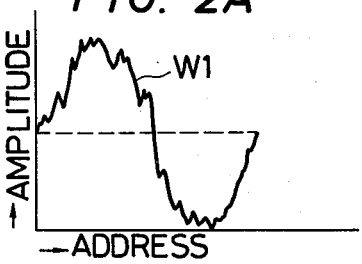
FIGS. 2A, 2B and 2C are charts showing an example of a set of waveshapes stored in respective waveshapes memories in FIG. 1.
Figure 2B:
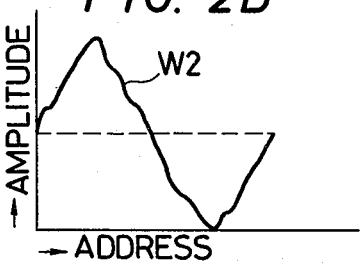
Figure 2C:
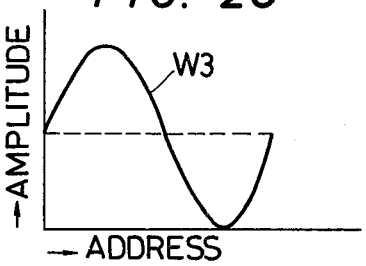
Figure 3:
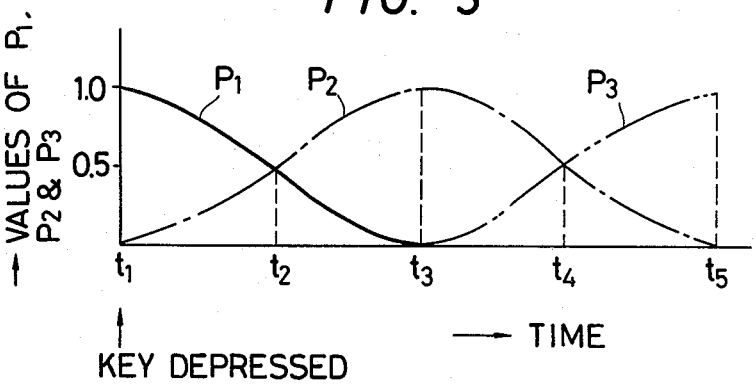
FIG. 3 is a chart showing an example of a set of parameters delivered from respective read-only memories in FIG. 1.
Figure 6:
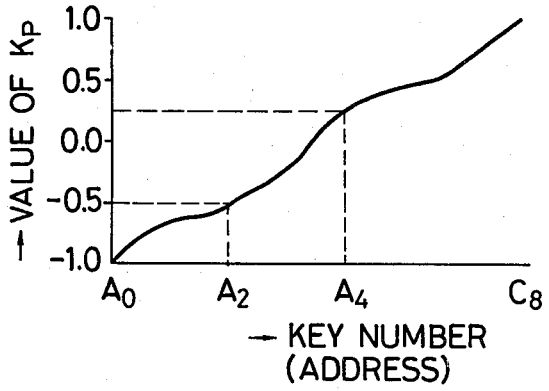
FIG. 6 is a chart showing an example of the output delivered from a key-dependent parameter table in FIG. 5.

In this embodiment of the invention, different waveshapes $W_1$, $W_2$ and $W_3$ as shown, for example, in FIGS. 2A, 2B and 2C are stored in the respective waveshape memories 4, 5 and 6. Let us assume here that the waveshape $W_1$ contains a large amount of higher harmonic components, that the waveshape $W_2$ contains a relatively small amount of higher harmonic components, and that the waveshape $W_3$ contains a very small amount of higher harmonic components. The key-dependent parameter table 31, which may be built with a read-only memory, contains at its individual storage locations (addresses) such a set of parameters (constants) $K_p$ corresponding to the respective keys which are, for example, $A_0$–$C_8$ (88 keys) as shown in FIG. 6. The time-dependent-parameter signal P(t) which is delivered from the parameter memory 33 which may be a read-only memory varies with lapse of time following the depression of a key in such pattern as plotted in FIG. 7, for instance. The parameter calculator 35 is designed to implement either one of the following Equations (1) and (2), in accordance with the nature of P'(t) which is either $P'(t)\geqq 0$ or $P'(t)<0$:

$$a=0,\ b=1-c,\ \text{and}\ c=P'(t):\ \text{for}\ P'(t)\geqq 0 \qquad \text{Eq(1)}$$

$$a=|P'(t)|,\ b=1-a,\ \text{and}\ c=0:\ \text{for}\ P'(t)<0 \qquad \text{Eq(2).}$$

Overall operation of the musical instrument according to the embodiment of the present invention will hereunder be described by referring to FIGS. 2A, 2B, 2C, 4, 5, 6 and 7.

Let us now consider the instance where a key of the keyboard which is assigned a key number $A_2$ is depressed (time $t_1$). The frequency information memory 2 is accessed with an address supplied from the keyboard circuit 1, and frequency information F corresponding to the depressed key $A_2$ is retrieved from the memory 2. The derived frequency information F is cumulatively added at each arrival of the clock pulse $\phi$ in the accumulator 3. The waveshape memories 4, 5 and 6 are successively addressed with the temporary contents of qF (q=1, 2, . . . ) of the accumulator 3 in synchronism with the clock pulse $\phi$, and the different waveshapes $W_1$, $W_2$ and $W_3$ are repetitively read out from these memories at a repetition rate corresponding to the tone pitch assigned to the depressed key $A_2$. Also, the key-dependent parameter table 31 in the circuit 30 is accessed with an address designated by the output of the keyboard circuit 1, so that there is delivered from the table 31 a parameter $K_p=-0.5$ which corresponds to the depressed key $A_2$.

Figure 4:
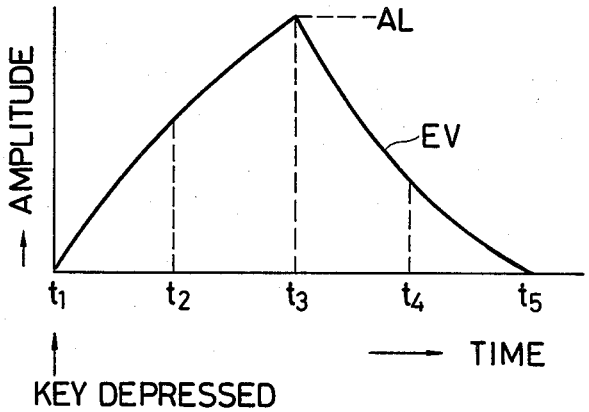
FIG. 4 is a chart showing an example of an evelope shape generated from an envelope generator in FIG. 1.
Figure 7:
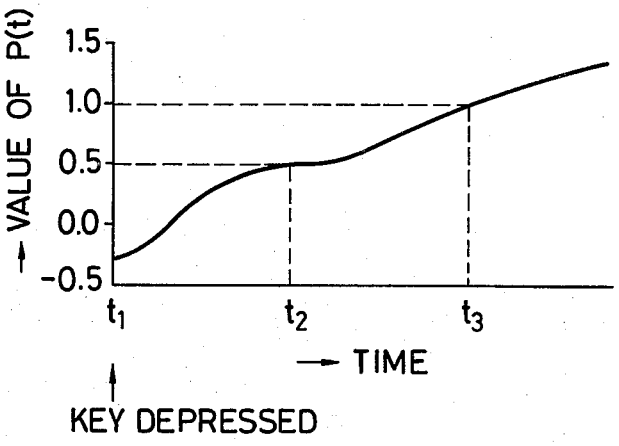
FIG. 7 is a chart showing an example of a time-dependent-parameter delivered from a parameter memory in FIG. 5.

Moreover, upon key depression, the keyboard circuit 1 generates a key-on signal KON. The counter 32 in the circuit 30 which is re-set by the key-on signal KON re-starts counting of the clock pulse $\phi$. At the same time therewith, the envelope generator 15 is initiated with the key-on signal KON and begins generation of such an envelope shape EV as shown in FIG. 4. Being accessed with the temporary contents of the counter 32 in synchronism with the clock pulse $\phi$, the parameter memory 33 delivers a time-dependent-parameter signal P(t) such as shown in FIG. 7. Addition of the parameters $K_p$ and P(t) is performed by the adder 34, and the resultant value $P'(t)=K_p+P(t)$ is received by the parameter calculator 35. It should be noted, here, that the parameter $K_p$ is one associated with the pitch of a musical tone to be produced and assigned to the depressed key, and it is −0.5 as shown in FIG. 6 since the depressed key number is $A_2$. Furthermore, the time-dependent-parameter P(t) is related to lapse of time after the depression of a key. In the parameter calculator 35, the variable parameter signals a, b and c are calculated using the output of the adder 34 in accordance with either Equation (1) or (2). The calculated variable parameters a, b and c are fed to their respective multipliers 7, 8 and 9 in the mixing circuit as stated above. As a result, the retrieved waveshapes $W_1$, $W_2$ and $W_3$ are mixed together at a variable mixing ratio according to the parameter signals a, b and c, as follows.

At the time $t_1$ when the key $A_2$ is depressed, $P(t)=-0.25$ (see FIG. 7) and $K_p=-0.5$, and hence $P'(t)=-0.75$. Accordingly, Equation (2) for $P'(t)<0$ is carried out at the parameter calcultor 35, and the variable parameters $a=0.75$, $b=0.25$ and $c=0.00$ are delivered. As a result, the adder 10 in the mixing circuit outputs a composite waveshape of the two waveshapes $W_1$ and $W_2$ mixed at a ratio of 3:1 (or 0.75:0.25), so that there is produced from the sound system 17 a musical tone containing a relatively large amount of higher harmonic components.

At the time $t_2$, $P(t)=0.5$ (see FIG. 7), and therefore $P'(t)=K_p+P(t)=0$. Accordingly, there are obtained variable parameters $a=0$, $b=1$, $c=0$ by carrying out Equation (1) for $P'(t)<0$, and consequently the output of the adder 10 contains only the component of the waveshape $W_2$. As a result, the musical instrument produces a musical tone containing a relatively small amount of higher harmonic components.

At the time $t_3$, $P(t)=1.0$, hence $P'(t)=0.5$. The parameter calculator 35 implements Equation (1) for $P'(t)<0$, and delivers variable parameter signals $a=0$, $b=0.5$ and $c=0.5$. Thus, the adder 10 outputs a composite waveshape of the waveshapes $W_2$ and $W_3$ mixed at a ratio of 1:1 (or 0.5:0.5). Accordingly, a musical tone containing a very small amount of higher harmonic components is produced from the sound system.

Let us now assume that a key $A_4$ is depressed. In this instance, the key-dependent parameter table 31 delivers a parameter signal $K_p=0.25$ (see FIG. 6).

At the time $t_1$ when the key $A_4$ is depressed, $P(t)=-0.25$, and then $P'(t)=0$. Therefore, parameter signals $a=0$, $b=1$ and $c=0$ are derived at the parameter calculator 35 by following Equation (1) for $P'(t)<0$. Accordingly, the output of the adder 10 in the mixing circuit contains only the component of the waveshape $W_2$, so that there is produced a tone containing a relatively small amount of higher harmonic components.

At the time $t_2$ of key depression, the parameters will be: $P(t)=0.5$ and $P'(t)=0.75$. The calculator 35, after carrying out Equation (1) for $P'(t)<0$, delivers parameter signals $a=0$, $b=0.25$ and $c=0.75$. Therefore, the adder 10 supplies a composite waveshape of the waveshapes $W_2$ and $W_3$ mixed at a ratio of 1:3 (or 0.25:0.75), so that a relatively simple tone containing a very small amount of higher harmonic components is produced from the sound system 17, i.e. a musical tone having a strongly stressed waveshape $W_3$ is pronounced.

At the time $t_3$, the parameters are: $P(t)=1.0$ and $P'(t)=1.25$. From the parameter calculator 35, parameter signals $a=0$, $b=-0.25$ and $c=1.25$ are supplied, respectively, to the mixing circuit. Hence, there is outputted from the adder 10 a composite waveshape of the inverted waveshape $W_2$ and the waveshape $W_3$ mixed at a ratio of 1:5 (or 0.25:1.25). Thus, the pronounced musical sound has extremely small amount of higher harmonic components.

Needless to say, the musical tone produced by the sound system 17 is envelope-controlled, i.e. it is imparted with an envelope characteristic specified by the envelope shape EV supplied from the envelope generator 15, so that the musical tone imparted with appropriate variation in volume (amplitude) is pronounced through the sound system 17.

As described above, the variable parameters a, b and c determining the mixing ratio of the waveshapes $W_1$, $W_2$ and $W_3$ are varied in accordance with the information as to which one of the keys in the keyboard is depressed and also with lapse of time following the key depression. Namely, the tone color of a produced tone changes with time and in accordance with the respective tone pitch. Further, a produced musical tone is given an envelope characteristic, i.e. an amplitude transient effect, according to an envelope shape EV generated in the instrument. Therefore, according to the present invention, it is possible to produce a musical tone much similar in tone color and amplitude variations to that of a natural musical instrument.

Description has been made with respect to the instances where key $A_2$ and key $A_4$ are depreseed, respectively. It should be understood that in case any other key is depressed, there is performed exactly the same pattern of operation such that a parameter (constant) $K_p$ regarding the pitch of the depressed key is read out from the key-dependent parameter table 31, and a parameter P(t) regarding the length of time of depression of the key is read out from the parameter memory 33, and on the basis of these two kinds of parameter signals $K_p$ and P(t), there are generated from the parameter calculator 35 those parameter signals a(t), b(t) and c(t) which are intended to impart relative significances to the respective musical tone waveshapes $W_1$, $W_2$ and $W_3$ which are outputted from the respective waveshape memories 4, 5 and 6. Accordingly, like in a natural musical instrument, it is possible to produce a musical sound which is such that the content of higher harmonic components varies depending on the tone pitch of the depressed key and that, in addition thereto, the waveshape configuration (tone color) varies continuously during the period from the time the musical tone is generated till the extinction of this tone.

It should be understood also that the number of the waveshape memories which have been shown as being three may be changed as desired. Also, the configuration of the waveshapes which are stored in these waveshape memories as well as the time-dependent parameters stored in the parameter memory may be selected as desired. Similarly, the variation pattern of the respective time-dependent parameters and the calculation algorithm for obtaining the mixing-ratio-determining parameters may be altered. Furthermore, the parameters stored in the key-dependent parameter table may be set so as to be common for each group of several keys of the keyboard.

What is claimed is:

1. An electronic musical instrument of keyboard type having a plurality of keys, comprising:

a plurality of waveshape storage means storing different waveshapes and accessible in response to an operation of tone selection means associated with said keys to deliver said different waveshapes, said waveshapes having the same fundamental frequency but different harmonic content;

mixing means for obtaining a composite waveshape of said different waveshapes mixed at a variable mixing ratio according to at least one variable parameter;

conversion means for converting said composite waveshape to a corresponding musical tone;

first information generating means for generating first information representing a time-dependent parameter related with time following depression of a key;

second information generating means for generating second information representing a key-dependent parameter related with the pitch of a tone assigned to the depressed key; and parameter generating means for generating said variable parameter on the basis of said first information and said second information, thereby producing in cooperation with said mixing means said composite waveshape, said composite waveshape being indicative of a musical tone having a harmonic content that varies in accordance with the pitch assigned to the depressed key and with lapse of time.

2. An electronic musical instrument according to claim 1, in which: said parameter generating means includes adding means for adding said time-dependent parameter and said key-dependent parameter, and arithmetic means for providing said variable parameter in accordance with an output of said adding means.

3. An electronic musical instrument according to claim 2, in which: said first information generating means comprises a counter for counting a timing signal in response to the depressed key and parameter storage means accessible with the content of said counter for generating said time-dependent parameter, and in which said second information generating means comprises another parameter storage means accessible with an address corresponding to the depressed key for generating said key-dependent parameter.

4. An electronic musical musical instrument according to claim 1, in which: the number of said at least one variable parameter is plural, and in which: said mixing means includes a plurality of multipliers for multiplying said respective different waveshapes by the respective variable parameters associated therewith, and an adder for adding up the products obtained at the multipliers to thereby produce said composite waveshape.

5. An electronic musical instrument according to claim 1, further comprising: variable envelope imparting means for imparting a variable envelope to said composite waveshape prior to its being fed to said conversion means.

6. An electronic musical instrument according to claim 5, in which: said variable envelope imparting means includes means responsive to the depressed key for generating an envelope signal, and means for multiplying said composite waveshape by the envelope signal and thereby supplying the resultant signal to said conversion means.

7. An electronic musical instrument according to claim 1, in which: said tone selection means includes means for supplying information representing the depressed key, and an accumulator receiving this information for cumulatively adding same at each arrival of a timing signal, and in which: said waveshape storage means are repetitively accessed with addresses designated by contents of said accumulator to deliver said different waveshapes stored therein.

8. In an electronic musical instrument including a keyboard circuit for selecting a note, a waveshape information generating means for obtaining composite waveshape information, and a sound system for producing sound from said composite waveshape information, the improvement comprising:

first information generating means responsive to an output of said keyboard circuit for providing a time-dependent signal indicative of a variation in tone color with lapse of time of a selected note;

second information generating means responsive to another output of said keyboard circuit for providing a key-dependent signal indicative of a variation in tone color with the pitch of said selected note; and parameter generating means responsive to said time-dependent signal and said key-dependent signal for obtaining a plurality of mixing parameters representative of pitch-time varying information;

wherein said waveshape information generating means is responsive to said output of said keyboard circuit and said plurality of mixing parameters.

9. An electronic musical instrument as in claim 8 further comprising envelope generating means for providing predetermined envelope shape information, and wherein said waveshape information generating means comprises:

a frequency information memory responsive to said keyboard circuit;

a plurality of waveshape storage means for storing digital representations of predetermined waveshapes;

an accumulator responsive to the output of said frequency information memory and operative to read out said digital representations at a rate determined by said keyboard circuit;

mixing means responsive to said digital representations and to said plurality of mixing parameters;

means responsive to the output of said mixing means and said envelope generating means for providing said composite waveshape information.

10. An electronic musical instrument as in claim 8 or 9 wherein said first information generating means further comprises:

a counter responsive to said output of said keyboard circuit and thereafter operative to count a timing signal;

a time-dependent information storage means responsive to the output of said counter for providing said time-dependent signal.

11. An electronic musical instrument as in claim 8 or 9 wherein said second information generating means comprises a key-dependent information storage means, said another output having a plurality of key-selected signals indicative of said selected note.

12. An electronic musical instrument as in claim 9 wherein:

said plurality of waveshape storage means is three; and said mixing means comprises three multipliers, each associated with a predetermined one of said waveshape storage means and with a predetermined one of said plurality of mixing parameters, and a first adder coupled to said multipliers for providing an output.

13. An electronic musical instrument as in claim 8 or 12 wherein said parameter generating means comprises:

a second adder responsive to said time-dependent signal and said key-dependent signal for providing a control parameter having a value X;

means responsive to said control parameter for providing said plurality of mixing parameters, said plurality being three and said three mixing parameters being representative of pitch-time varying information having a set of respective values zero, one minus X, and X when X is greater than zero; said set when X is equal to zero; and another set of respective values absolute value of X, one minus absolute value of X, and zero when X is less than zero.

14. In an electronic musical instrument of the type including a plurality of waveshape memories having stored therein sample values of respective waveshapes of different harmonic content, each of said respective waveshapes defining a single cycle, means for repeatedly reading out said sample values from each of said waveshape memories, means for mixing said sample values in accordance with a plurality of mixing parameters to provide a proportional mix of sample values, means for imparting a predetermined attack/delay function to said proportional mix of sample values to obtain a composite signal, and means responsive to said composite signal for generating an audio tone, the improvement comprising:

first information generating means for providing a time-dependent signal varying continuously as determined by lapse of time;

second information generating means for providing a pitch-dependent signal, said pitch-dependent signal having a predetermined value for each pitch;

an adder responsive to said time-dependent and pitch-dependent signals for obtaining a time-pitch dependent signal; and means responsive to said time-pitch dependent signal for obtaining said plurality of mixing parameters.

* * * * *